US005707955A

United States Patent [19]

Gomes et al.

[11] Patent Number: 5,707,955

[45] Date of Patent: Jan. 13, 1998

[54] HIGH FOAMING NONIONIC SURFACTANT BASED LIQUID DETERGENT

[75] Inventors: Gilbert S. Gomes, Somerset; Elizabeth McCandlish, Highland Park; George Fischler, Basking Ridge, all of N.J.

[73] Assignee: Colgate-Palmolive Co., Piscataway, N.J.

[21] Appl. No.: 680,194

[22] Filed: Jul. 15, 1996

[51] Int. Cl.[6] ..... C11D 11/00; C11D 9/00

[52] U.S. Cl. ..... 510/421; 510/422; 510/424; 510/426; 510/427

[58] Field of Search ..... 510/427, 424, 510/426, 421

[56] References Cited

U.S. PATENT DOCUMENTS

| | | | |
|---|---|---|---|
| 3,658,985 | 4/1972 | Olson et al. | 424/70 |
| 3,769,398 | 10/1973 | Hewitt | 424/70 |
| 3,935,129 | 1/1976 | Jabalee | 252/153 |
| 4,013,787 | 3/1977 | Verlerberghe | 424/70 |
| 4,129,515 | 12/1978 | Foster | 252/117 |
| 4,154,706 | 5/1979 | Kenkare et al. | 252/547 |
| 4,224,195 | 9/1980 | Kawasaki et al. | 252/546 |
| 4,259,204 | 3/1981 | Homme | 252/174.16 |
| 4,329,334 | 5/1982 | Su et al. | 424/70 |
| 4,329,335 | 5/1982 | Su et al. | 424/70 |
| 4,329,336 | 5/1982 | Su et al. | 424/70 |
| 4,450,091 | 5/1984 | Schmolka | 252/174.2 |
| 4,595,526 | 6/1986 | Lai | 252/545 |
| 4,649,497 | 3/1987 | Akred et al. | 252/135 |
| 4,671,895 | 6/1987 | Erilli et al. | 252/552 |
| 4,851,149 | 7/1989 | Carandang | 252/147 |
| 5,076,954 | 12/1991 | Coth et al. | 252/111 |
| 5,415,812 | 5/1995 | Durbut et al. | 252/547 |
| 5,580,848 | 12/1996 | Drapier | 510/417 |
| 5,626,843 | 5/1997 | Haslop et al. | 252/135 |

*Primary Examiner*—Christine Skane
*Assistant Examiner*—Necholus Ogden
*Attorney, Agent, or Firm*—Richard E. Nanfeldt

[57] ABSTRACT

A high foaming, light duty, liquid detergent with desirable cleansing properties and mildness to the human skin comprising a disinfecting agent, four essential surfactants: a water soluble nonionic surfactant, a $C_{8-18}$ ethoxylated alkyl ether sulfate anionic surfactant, two sulfonate surfactants, and the balance being water.

5 Claims, No Drawings

HIGH FOAMING NONIONIC SURFACTANT BASED LIQUID DETERGENT

BACKGROUND OF THE INVENTION

The present invention relates to novel light duty liquid detergent compositions with high foaming properties, containing a nonionic surfactant, three sulfonate surfactants, and an ethoxylated alkyl ether sulfate surfactant, a disinfectant agent and water.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major active ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water but fails to disclose an alkyl polysaccharide surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent containing a disinfecting agent can be formulated with a nonionic surfactant and three anionic surfactants which has desirable cleaning properties, mildness to the human skin.

An object of this invention is to provide novel, liquid detergent composition containing a nonionic surfactant, two sulfonate surfactants, an ethoxylated alkyl ether sulfate surfactant, a disinfecting agent and water wherein the composition does not contain any amine oxide, HEDTA, fatty acid alkanolamides, organic nitrogen containing compounds, betaines, clays, silicas, abrasives, alkali metal carbonates, alkaline earth metal carbonates, alkyl glycine surfactant, cyclic imidinium surfactant, or more than 3 wt. % of a fatty acid or salt thereof.

Another object of this invention is to provide a novel, liquid detergent with desirable high foaming and disinfecting properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

Iodine has been widely used to effectively kill a broad spectrum of microorganisms. Iodophors or elemental iodine complexed with certain polymers or surfactants have also been found to exhibit biocidal activity similar to that of the free iodine. Iodophors are letal to viruses, bacteria (including spores) fungi, protozoa, and algae. Iodophors and free iodine are broadly biocidal against microorganisms, but iodophors offer several advantages over free iodine. The major advantage is the reduction of odor. The vapor pressure of iodine complexed with surfactant is essentially zero. The iodophors are much more stable than tincture of iodine. Iodine staining and also corrosion are reduced when complexed in an iodophor. Skin irritancy from an iodophor is much less than from iodine tincture.

Since an iodophor has disinfectant properties, it should be possible to also use its surface active properties to develop a disinfectant dishwashing liquid. Iodine appears to be relatively safe for humans. U.S. Government studies have shown concentrations up to 5 ppm in drinking water were not deleterious to health. The U.S. army distributed Globaline tablets to serve men during World War II for disinfection of drinking water. Iodophors are used in the food and dairy industry to clean and disinfect food processing equipment surfaces as well as surfaces of transportation equipment that contact food. Iodophors are routinely used on dairy farm cows to prevent mastitis. Iodophors are used in surgical procedures by both doctor and patient and are frequently applied prior to injections. Diatomic halogens may react with nitrogen containing molecules such as ammonia or ammonium ion. Betaines and amides may also be incompatible.

To achieve the foregoing and other objects and in accordance with the purpose of the present invention, as embodied and broadly described herein the novel, high foaming, light duty liquid detergent composition containing a disinfecting agent comprises four essential surfactants: a water soluble, ethoxylated, nonionic surfactant, a foaming anionic sulfonate surfactants, and an ethoxylated alkyl ether sulfate surfactant, wherein the surfactants are dissolved in an aqueous vehicle wherein the composition does not contain any amine oxide, HEDTA, fatty acid alkanolamides, clays, silicas, abrasives, clay or polymeric thickeners, alkali metal carbonates, alkaline earth metal carbonates, clay or polymeric thickener, alkyl glycine surfactant, cyclic imidinium surfactant or more than 3 wt. % of a fatty acid or salt thereof.

DETAILED DESCRIPTION OF THE INVENTION

The high foaming nonionic based light duty liquid detergent compositions of the instant invention comprise approximately by weight: 5 to 15 wt. % of a water soluble nonionic surfactant; 0.5 to 10 wt. % of a sodium salt of a $C_8$–$C_{16}$ alkyl benzene sulfonate surfactant, 0.5 to 10 wt. % of a magnesium salt of a $C_8$–$C_{16}$ alkyl benzene sulfonate surfactant, anionic surfactant; 5 to 15% of an ethoxylated alkyl ether sulfate surfactant and 150 to 1000 ppm of a disinfecting agent; the balance being water, wherein the compositions do not contain any amine oxides, fatty acid alkanol amides (for example—cocodiethanol amide), formate, calcium carbonate, abrasives, clays, silicas, alkyl glycine surfactant, cyclic imidinium surfactant, betaines, nitrogen containing organic compounds, or more than 3 wt. % of a fatty acid or a metal salt of the fatty acid.

The disinfecting agent of the instant invention is an iodine powder which is complexed with the nonionic surfactant of the composition such that the concentration of the iodine powder in the complex which is called an Iodophor is about 0.5 to about 1.5 wt. %.

The nonionic surfactant is present in amounts of about 1 to 10%, preferably 2 to 9% by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_{11}$ alkanol condensed with 9 moles of ethylene oxide (Neodol 1–9), $C_{12-13}$ alkanol condensed with 6.5 moles ethylene oxide (Neodol 23-6.5), $C_{12-15}$ alkanol condensed with 7 or 3 moles ethylene oxide (Neodol 25-7 or Neodol 25-3), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The disinfecting agent of the instant invention is an iodine powder which is complexed with the nonionic surfactant of the composition such that the concentration of the iodine powder in the complex which is called an Iodophor is about 0.5 to about 1.5 wt. %.

The $C_{8-18}$ ethoxylated alkyl ether sulfate surfactants have the structure $R\text{-}(OCHCH_2)_nOSO_3^M$ wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an ammonium cation or an alkali metal cation, most preferably sodium. The $C_8$–$C_{18}$ ethoxylated alkyl ether sulfate surfactant is present in the composition at a concentration of about 0.5 to about 8.0 wt. %, more preferably about 1.0 to 7.0 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule also are suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %

The iodine powder is added to the nonionic surfactant at room temperature with agitation to form an Iodophor which comprises 98 wt. % to 99.75 wt. % of the nonionic surfactant and 0.25 wt. % to 2 wt. % of the iodine powder. The Iodophor together with the two alkyl benzene sulfonate surfactants and the ethoxylated alkyl ether sulfate surfactant are solubilized in an aqueous medium comprising water and optionally, solubilizing ingredients such as $C_2$–$C_3$ mono and di- hydoroxy alkanols, e.g., ethanol, isopropanol and propylene glycol. Suitable water soluble hydrotropic salts include sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from about 1% to 15%, preferably 2% to 12%, most preferably 3% to 8%, by weight of the detergent composition with the proportion of ethanol, when present, being 5% of weight or less in order to provide a composition having a flash point above about 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 8.0 wt. %, preferably 1 to 6 wt. % to modify the cloud point of the nonionic surfactant and thereby control the haze of the resultant solution. Various other ingredients such as urea at a concentration of about 0.5 to 4.0 wt. % or urea at the same concentration in combination with ethanol at a concentration of about 0.5 to 4.0 wt. % can be used as solubilizing agents. Another extremely effective solubilizing or cosolubilizing agent used at a concentration of about 0.1 to 5 wt. percent, more preferably about 0.5 to 4.0 weight percent is isethionic acid or an alkali metal salt of isethionic acid having the formula:

$$CH_2OHCH_2SO_3X$$

wherein X is hydrogen or an alkali metal cation, preferably sodium. Other ingredients which have been added to the compositions at concentrations of about 0.1 to 4.0 wt. percent are perfumes, sodium bisulfite, ETDA, isoethionic and proteins such as lexeine protein.

The foregoing solubilizing ingredients also facilitate the manufacture of the inventive compositions because they tend to inhibit gel formation.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will be about 1% to 15% of weight of the detergent composition, and the percentages of most of such individual components will be a maximum of 5% by weight and preferably less than about 2% by weight. Sodium formate can be included in the formula as a perservative at a concentration of 0.1 to 4.0%. Other preservatives are dibromodicyanobutane, citric acid, benzylic alcohol and poly (Hexamethylene) biguanidium hydrochloride and mixtures thereof. Sodium bisulfite can be used as a color stabilizer at a concentration of about 0.01 to 0.2 wt. %.

The present light duty liquid detergents such as dishwashing liquids are readily made by simple mixing methods from readily available components which, on storage, do not adversely affect the entire composition. However, it is preferred that the nonionic Iodophor be mixed with the solubilizing ingredients, e.g., ethanol and, if present, prior to the addition of the water to prevent possible gelation. The composition is prepared by sequentially adding with agitation the alkali metal salt of the $C_{8-18}$ ethoxylated alkyl ether sulfate, and then the two sulphonate surfactants and the nonionic Iodophor which has been previously optionally been mixed with a solubilizing agent such as ethyl alcohol and/or sodium xylene sulfonate to assist in solubilizing said surfactants, and then adding with agitation the formula amount of water to form an aqueous solution of the detergent composition. The use of mild heating (up to 100° C.) assists in the solubilization of the surfactants. The viscosities are adjustable by changing the total percentage of active ingredients. No polymeric or clay thickening agent is added. In all such cases the product made will be pourable from a relatively narrow mouth bottle (1.5 cm. diameter) or opening, and the viscosity of the detergent formulation will not be so low as to be like water. The viscosity of the detergent desirably will be at least 100 centipoises (cps) at room temperature, but may be up to about 1,000 centipoises as measured with a Brookfield Viscometer using a number 2 spindle rotating at 30 rpms. Its viscosity may approximate those of commercially acceptable detergents now on the market. The detergent viscosity and the detergent itself remain stable on storage for lengthy periods of time, without color changes or settling out of any insoluble materials. The pH of this formation is substantially neutral to skin, e.g., about 4.5 to 8 and preferably about 7.0.

These products have unexpectedly desirable properties. For example, the foam quality and detersive property is equal to or better than standard light duty liquid detergents while using a nonionic surfactant as the primary surfactant and minimal amounts of anionic surfactant, thereby achieving a less irritating liquid detergent than the standard light duty liquid detergent.

The following examples are merely illustrative of the invention and are not to be construed as limiting thereof.

DESCRIPTION OF THE PREFERRED EMBODIMENTS

EXAMPLE 1

The following formulas were prepared at room temperature by simple liquid mixing procedures as previously described.

| | A |
|---|---|
| Neodol 1-9 Iodophor[1] | 10.0 |
| Sodium Lauryl Ether Sulfate (AEOS) (2.0 EO) | 10.0 |
| Sodium linear alkyl benzene sulfonate | 5.0 |
| Magnesium linear alkyl benzene sulfonate | 5.0 |
| Water | Balance |
| Appearance | Clear |
| Clear Point less than | 13° C. |
| Cloud Point less than | 0° C. |
| Brookfield Viscosity - #2 spindle, 30 rpms cps | 250 |

[1]Neodol 1-9 Iodophor comprises 99.5 wt. % of Neodol 1-9 and 0.5 wt. % of iodine.

Formula A was tested for antimicrobial activity.

Antimicrobial Testing-Kill/Time Test

Formula A

Subject: LDL w/500 ppm iodine (25% solution @5 and 10 min. contact times)

Method: SPI MIC 1010-02 vs. *E. coli* ATCC 8739, *S. choleraesuis*, ATCC 10708 and *P. aeruginosa* ATCC 15442

| | | | | | | | | | |
|---|---|---|---|---|---|---|---|---|---|
| | | | | 5 minutes contact time | | | | | |
| *E. coli* | $1 \times 10^2$ | | $1 \times 10^3$ | | $1 \times 10^4$ | | $1 \times 10^5$ | | log |
| $H_2O$ | TNTC | TNTC | TNTC | TNTC | TNTC | TNTC | 36 | 39 | 6.6 |
| 16569 | 0 | 0 | 0 | 0 | 0 | 0 | 0 | 0 | <2.0 |
| 16569 Log Reduction >4.6 | | | | | | | | | |
| *S. choleraesuis* | $1 \times 10^2$ | | $1 \times 10^3$ | | $1 \times 10^4$ | | $1 \times 10^5$ | | log |
| $H_2O$ | TNTC | TNTC | TNTC | TNTC | TNTC | TNTC | 47 | 49 | 6.5 |
| 16569 | 0 | 0 | 0 | 0 | 0 | 0 | 0 | 0 | <2.0 |
| 16569 Log Reduction >4.5 | | | | | | | | | |
| *P. aeruginosa* | $1 \times 10^2$ | | $1 \times 10^3$ | | $1 \times 10^4$ | | $1 \times 10^5$ | | log |
| $H_2O$ | TNTC | TNTC | TNTC | TNTC | TNTC | TNTC | 47 | 49 | 6.7 |
| 16569 | 0 | 0 | 0 | 0 | 0 | 0 | 0 | 0 | <2.0 |
| 16569 Log Reduction >4.7 | | | | | | | | | |
| | | | | 10 minutes contact time | | | | | |
| *E. coli* | $1 \times 10^2$ | | $1 \times 10^3$ | | $1 \times 10^4$ | | $1 \times 10^5$ | | log |
| $H_2O$ | TNTC | TNTC | TNTC | TNTC | TNTC | TNTC | 49 | 46 | 6.7 |
| 16569 | 0 | 0 | 0 | 0 | 0 | 0 | 0 | 0 | <2.0 |
| 16569 Log Reduction >4.7 | | | | | | | | | |
| *S. choleraesuis* | $1 \times 10^2$ | | $1 \times 10^3$ | | $1 \times 10^4$ | | $1 \times 10^5$ | | log |
| $H_2O$ | TNTC | TNTC | TNTC | TNTC | TNTC | TNTC | 42 | 39 | 6.6 |
| 16569 | 0 | 0 | 0 | 0 | 0 | 0 | 0 | 0 | <2.0 |

-continued

| 16569 Log Reduction >4.6 *P. aeruginosa* | $1 \times 10^2$ | | $1 \times 10^3$ | | $1 \times 10^4$ | | $1 \times 10^5$ | | log |
|---|---|---|---|---|---|---|---|---|---|
| $H_2O$ | TNTC | TNTC | TNTC | TNTC | TNTC | TNTC | 55 | 59 | 6.8 |
| 16569 | 0 | 0 | 0 | 0 | 0 | 0 | 0 | 0 | <2.0 |

16569 Log Reduction >4.8

Conclusion: The results of this test indicate that Formula A has a high level of in-vitro activity.

What is claimed is:

1. A high foaming light duty, liquid detergent comprising approximately by weight:

(a) 5% to 15% of a water soluble nonionic surfactant selected from the group consisting of primary and secondary $C_{8-18}$ alkanol condensates with 5 to 30 moles of ethylene oxide, condensates of $C_{8-18}$ alkylphenol with 5 to 30 moles of ethylene oxide, condensates of $C_{8-20}$ alkanol with a heteric mixture of ethylene oxide and propylene oxide having a weight ratio of ethylene oxide to propylene oxide from 2.5:1 to 4:1 and a total alkylene oxide content of 60% to 85% by weight and condensates of 2 to 30 moles of ethylene oxide with sorbitan mono and tri-$C_{10-20}$ alkanoic add esters having an HLB of 8 to 15;

(b) 5% to 15% of a water-soluble anionic detergent which is an ammonium or alkali metal salt of a $C_{8-18}$ ethoxylated alkyl ether sulfate;

(c) 0.5% to 10% of an alkyl metal salt of a linear alkyl benzene sulfonate sulfonate;

(d) 0.5% to 10% of an alkaline earth metal salt of a linear alkyl benzene sulfonate;

(e) 0.5% to 1.5% of an iodine powder which is complexed with said nonionic surfactant; and (f) the balance being water.

2. A liquid detergent composition according to claim 1, wherein said nonionic surfactant is said condensate of a primary $C_8$–$C_{18}$ alkanol with 5 to 30 moles of ethylene oxide.

3. A liquid detergent composition according to claim 1 further including a preservative.

4. A liquid detergent composition, according to claim 1, further including a color stabilizer.

5. A liquid detergent composition according to claim 1, further including about 1.0 to about 15 wt. % of a cosolubilizing agent selected from the group consisting of $C_{2-3}$ mono- and di-hydroxy alkanols, water soluble salts of $C_{1-3}$ substituted benzene sulfonate hydrotropes and mixtures thereof.

* * * * *